United States Patent [19]

Dwyer

[11] 4,104,973

[45] Aug. 8, 1978

[54] METHOD AND APPARATUS FOR DISPLAYING BREAD IN SUPERMARKETS

[76] Inventor: John R. Dwyer, 3660 Culpepper Dr., Erie, Pa. 16506

[21] Appl. No.: 604,356

[22] Filed: Aug. 13, 1975

[51] Int. Cl.[2] ..... A47B 57/00

[52] U.S. Cl. ..... 108/59; 312/114

[58] Field of Search ..... 248/416; 52/33; 108/59; 186/1 AC, 1 B, 1 A, 27, 31; 223/DIG. 3, 85, 120; 312/114, 135, 136, 201, 202, 283, 287, 198, 237, 107, 135, 270; 280/79.3; 211/151, 163, 168, 100, 97, 162; 214/16.4 A

[56] References Cited

U.S. PATENT DOCUMENTS

| | | | |
|---|---|---|---|
| 1,550,630 | 8/1925 | Payzant | 312/250 X |
| 1,975,651 | 10/1934 | Wolfe | 280/79.3 |
| 2,282,835 | 5/1942 | Vanderveld | 248/416 |
| 2,451,110 | 10/1948 | Newman | 211/94 |
| 2,742,675 | 4/1956 | Robertson | 312/250 X |
| 2,926,022 | 2/1960 | Nau et al. | 280/79.3 |
| 3,053,602 | 9/1962 | Golenpaul | 312/201 |
| 3,356,434 | 12/1967 | Theodores | 312/250 |
| 3,575,440 | 4/1971 | Lay | 280/79.3 |
| 3,698,735 | 10/1972 | Bloomfield | 280/79.3 |

FOREIGN PATENT DOCUMENTS

| | | | |
|---|---|---|---|
| 300,053 | 6/1968 | Sweden | 312/250 |

*Primary Examiner*—James T. McCall
*Attorney, Agent, or Firm*—Ralph Hammar

[57] ABSTRACT

A mobile bread unit which replaces the lower shelves of a display rack for bakery products and carries front and back rows of bread so that as the front row is sold, the unit may be pulled out, reversed and reinserted to bring the back row into position.

6 Claims, 2 Drawing Figures

METHOD AND APPARATUS FOR DISPLAYING BREAD IN SUPERMARKETS

This invention is intended to simplify the servicing of supermarket display racks for large volume bakery products such as white bread by replacing the lower shelves of the usual display rack with a truck having shelves and which carry front and back rows of bread. When the front row is sold, reversal of the truck brings the back row to the front thereby restoring a fresh display with a minimum of time and effort.

Figure 1:
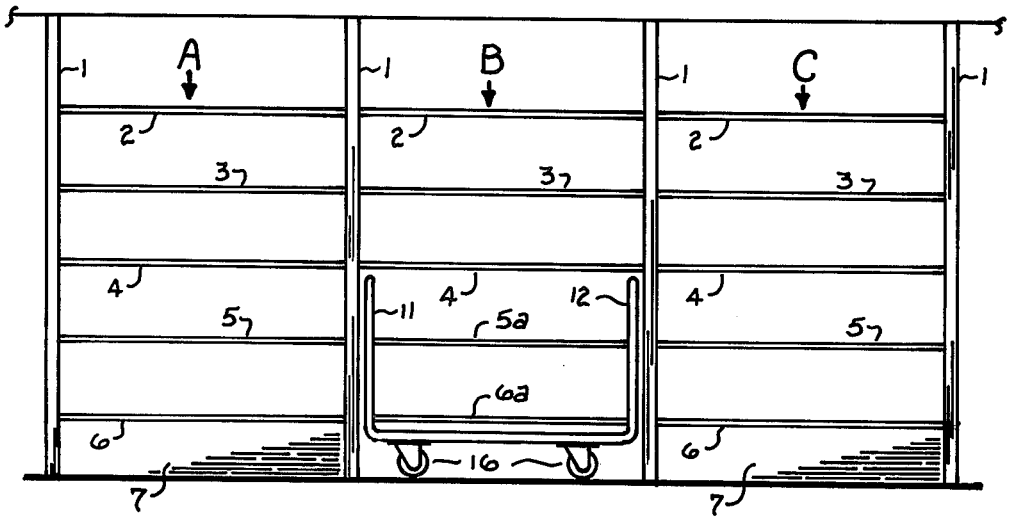
Figure 2:
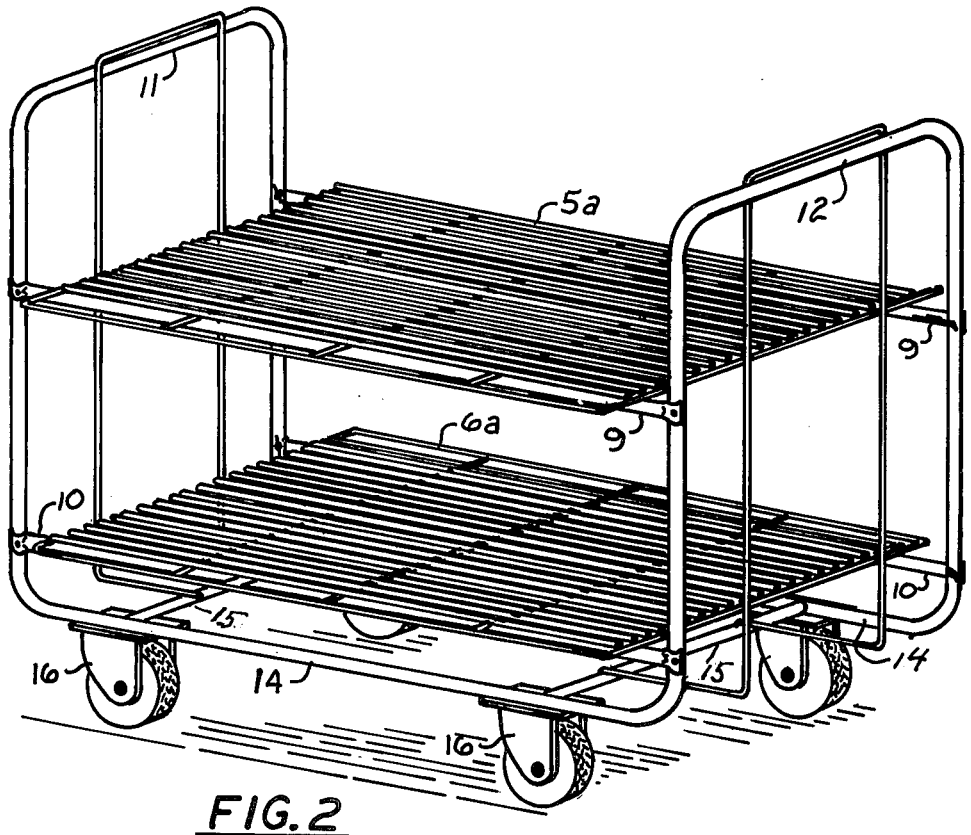

In the drawing FIG. 1 is a diagramatic front elevation of three sections of display racks used in supermarkets for bakery products, two sections being conventional and the third section embodying the invention, and FIG. 2 is a perspective of a mobile unit having shelves holding front and back rows of bread.

Supermarket racks for bread, cakes and other bakery products usually consist of shelving about four feet wide and twenty-four or thirty inches deep. Under prior practice, all three units of A,B, and C would be identical and would consist of uprights 1, shelves 2,3,4,5,6 and a kickplate 7 flush with the front edge of each lowermost shelf 6. Large volume items such as white bread are usually loaded on shelves 5 and 6 with the loaves filling the full depth of the shelves. When the front of the shelf is sold out, the loaves at the back of the shelves are pulled forward and rearranged at the front. This is inconvenient and time consuming. The loaves at the back must be handled twice.

To overcome this difficulty one or more units modified as shown at B by removing the two lower shelves 5,6 and the kick plate 7 leaving a pocket for receiving a truck 8 shown in detail in FIG. 2.

The truck has horizontal struts 9,10 supporting shelves **5*a* and 6*a* in line with shelves 5,6 and end members 11,12 by which the truck may be moved. The end members are connected by frame having longitudinal and cross struts 14,15. At the corners of the frame are casters 16 supporting the truck. The frame 14,15 and the casters 16 are recessed inward from the sides and ends of the shelves. The end members 10,11 are spaced to be easily received between the uprights 1. This permits the truck when loaded with bread to be removably inserted within the pocket provided by the removal of the shelves 5,6 and the kick plate 7**.

Each shelf of the truck is loaded with two rows of bread with the individual loaves side by side and with one row along each longitudinal edge of the shelf. This can be done in a storage room or in any other convenient location. The loaded truck is then wheeled to place and inserted into the pocket in Unit B. When bread on the front of the shelves **5*a*,6*a*** is sold the bread at the back is brought to the front by pulling the truck out of the pocket, turning the truck end for end and reinserting the truck in the pocket exposing two fully loaded shelves with the bread in freshly arranged rows.

In a large supermarket there probably would be two or three sections corresponding to unit B and a spare truck which would be kept fully loaded in a storeroom in readiness for exchange for an empty truck.

I claim:

1. A display for bakery products having vertical uprights with horizontal shelves between the upper portions of the uprights open to the front of the display, a pocket between the uprights below the shelves and likewise open to the front of the display, a truck removably received in said pocket, said truck having end frames adjacent the uprights and at least one horizontal shelf extending lengthwise between the end frames and depthwise into said pocket so one horizontal edge of the shelf is at the front of the display and the other horizontal edge of the shelf is at the back of the display, said shelf being adapted for supporting a row of loaves of bread along each horizontal edge with the individual loaves side by side so that when the row at the front of the display is sold the other row may be brought to the front by moving the truck out of the pocket, turning the truck end for end and reinserting the truck in the pocket.

2. Using the apparatus of claim 1 the method of displaying bread which comprises loading a row of loaves of bread along each horizontal edge of the shelf of the truck with the individual loaves side by side, inserting the truck in the pocket so one row is at the front and the other row is at the back of the display and when the row at the front row is sold, moving the truck out of the pocket, turning the truck end for end and reinserting the truck in the pocket.

3. The display of claim 1 in which the truck is supported by casters at the corners of the end frames and the end frames and casters are recessed inward from the sides and ends of the shelves.

4. Using the display apparatus of claim 3, the method of displaying bread which comprises loading a row of loaves of bread along each horizontal edge of the shelf of the truck with the individual loaves side by side, inserting the truck in the pocket so one row is at the front and the other row is at the back of the display and when the row at the front row is sold, moving the truck out of the pocket, turning the truck end for end and reinserting the truck in the pocket.

5. The display of claim 1 in which the truck is a mobile four wheeled unit which may be loaded in a storage room and wheeled to the display.

6. Using the display of claim 5 the method of displaying bread which comprises loading a row of loaves of bread along each horizontal edge of the shelf of the truck with the individual loaves side by side, inserting the truck in the pocket so one row is at the front and the other row is at the back of the display and when the row at the front row is sold, moving the truck out of the pocket, turning the truck end for end and reinserting the truck in the pocket.

* * * * *